US005873405A

United States Patent [19]

Carrier et al.

[11] Patent Number: 5,873,405

[45] Date of Patent: Feb. 23, 1999

[54] PROCESS AND APPARATUS FOR DIRECT CHILL CASTING

[75] Inventors: Claude Carrier; Clark Howard Weaver, both of Chicoutimi, Canada

[73] Assignee: Alcan International Limited, Montreal, Canada

[21] Appl. No.: 870,029

[22] Filed: Jun. 5, 1997

[51] Int. Cl.[6] ..... B22D 11/07

[52] U.S. Cl. ..... 164/472; 164/487; 164/268

[58] Field of Search ..... 164/444, 472, 164/487, 268

[56] References Cited

U.S. PATENT DOCUMENTS

| | | |
|---|---|---|
| 4,157,728 | 6/1979 | Mitamura et al. . |
| 4,355,679 | 10/1982 | Wilkins . |
| 4,598,763 | 7/1986 | Wagstaff et al. . |
| 4,709,744 | 12/1987 | Bryson et al. . |
| 4,962,807 | 10/1990 | Naess et al. . |
| 5,027,887 | 7/1991 | Bakshi et al. . |
| 5,170,838 | 12/1992 | Theler et al. . |

FOREIGN PATENT DOCUMENTS

| | | |
|---|---|---|
| A-50653/96 | 11/1996 | Australia . |
| 0 035 958 B1 | 7/1984 | European Pat. Off. . |
| 0 167 056 A2 | 6/1985 | European Pat. Off. . |
| 03-000452 | 1/1991 | Japan . |
| 652 325 A5 | 11/1985 | Switzerland . |
| 667225 | 9/1988 | Switzerland . |
| 686413 | 1/1953 | United Kingdom . |
| 1130622 | 10/1968 | United Kingdom . |
| 1144208 | 3/1969 | United Kingdom . |

*Primary Examiner*—Kuang Y. Lin
*Attorney, Agent, or Firm*—Cooper & Dunham LLP

[57] ABSTRACT

A process and apparatus are described for direct chill casting. The apparatus comprises an open ended mould cavity formed by a casting surface with an upper and lower end. A refractory sleeve is located at the upper end of this mould cavity and has an inner diameter less than the inner diameter of the mould, whereby the sleeve forms an overhang with the mould cavity. This sleeve is adapted to receive molten metal. Below the lower end of the mould, means are provided for supplying coolant to chill the descending hot metal body thereby forming an ingot. A permeable wall element is disposed in the peripheral wall of the mould cavity below the overhang and this element has an inner wall forming part of the cavity. Means are provided for feeding gas into and through the permeable wall element to discharge through its inner wall. An annular oil plate is mounted between the overhang and the permeable wall element and this oil plate has grooves in its bottom face thereby providing access for lubricating oil to the mould cavity. An oil supply means for feeding a volumetrically controlled amount of lubricating oil through the grooves to the mould cavity. In this way, oil and gas are supplied to the mould cavity to form an oil and/or gas layer between the metal and the wall of the mould.

12 Claims, 2 Drawing Sheets

PROCESS AND APPARATUS FOR DIRECT CHILL CASTING

FIELD OF THE INVENTION

This invention relates to an apparatus and method for direct chill casting of molten metal and, in particular, the direct chill casting of aluminum alloy billets.

BACKGROUND OF THE INVENTION

The need for extrusion billets with high quality surfaces to minimize waste in the extrusion process has been recognized for many years. A useful technique for achieving such quality has been to use an open-ended casting mould having a refractory inlet section, i.e. a "hot top", forming an overhang below which the molten metal spreads out to form a meniscus in the resulting corner of the overhang, and to solidify while in contact with the chilled mould surface below the overhang. It has been mould that the injection of gas and liquid lubricant into the area below the overhang in such mould gives beneficial results to the surface of the ingot.

Mitamura et al, U.S. Pat. No. 4,157,728 discloses the injection of gas into the upper corner of the mould, immediately below the overhang, with lubricant generally injected at a point slightly below the gas. The gas and oil were both delivered to the mould face by means of small holes or channels drilled in the mould from a delivery channel or ring to the mould face. The gas flow was adjusted to cause a slight pressure increase and thereby force the meniscus slightly away from the corner. The lubricant flowed down the mould face in the usual manner. This method of delivery of gas kept the gas and lubricant generally isolated from each other and further, a very stable and finely adjustable gas flow control was needed to control the gas pressure.

In Wagstaff et al, U.S. Pat. No. 4,598,763 there is disclosed the use of a porous graphite ring which forms at least part of the mould wall below the overhang. Gas and liquid lubricant are delivered to grooves behind the ring or in the surface of the ring opposite the mould surface, and mixed within the ring to form a gas-lubricant mixture which spreads out over the surface of the ring to provide such a mixture in contact with the solidifying ingot. This approach permits higher gas delivery pressures behind the ring and simplifies the control of gas flow. However, the oil gradually fills the porosity in the graphite rings particularly if it reacts because of the heat from the solidifying casting, and its flow control characteristics therefore change in time. The graphite must be carefully selected to ensure uniform delivery of the gas-lubricant mixture.

Steen et al, Australian Application AU-50653/96 discloses the use of separate porous rings or wall members forming part of the mould wall in the above mould type. The two porous wall members are separated by an impervious seal. Gas is introduced through the lower porous member and liquid lubricant through the upper. The lower member therefore remains uncontacted by oil except on the casting face and retains its control properties for longer periods of time. The construction of such mould with two porous wall members and an intermediate seal is more complex, and the use of a porous wall member for lubricant delivery can still result in slow changes to its characteristics. For example, it may be necessary to increase the lubricant oil delivery pressure. Lubricant filled wall members will also require periodic replacement.

There is, therefore, a need for a simple and reliable hot top mould design permitting gas and lubricant delivery below the overhang, which is easy to control and can operate for long periods between maintenance.

It is an object of the invention to provide a direct chill casting mould permitting gas and lubricant delivery to the casting surface which has stable gas and lubricant supply over several casts.

It is a further object of the invention to provide a direct chill casting mould permitting gas and lubricant delivery to the casting surface which is easily maintained.

SUMMARY OF THE INVENTION

The apparatus embodiment of this invention is a casting apparatus for the direct chill casting of a metal, such as aluminum. The apparatus comprises an open ended mould cavity formed by a casting surface with an upper and lower end. A refractory sleeve is located at the upper end of this mould cavity and has an inner diameter less than the inner diameter of the mould, whereby the sleeve forms an overhang with the mould cavity. This sleeve is adapted to receive molten metal. Below the lower end of the mould, there is provided a coolant delivery system for supplying collant to chill the descending hot metal body thereby forming an ingot. A permeable wall element is disposed in the peripheral wall of the mould cavity below the overhang and this element has an inner wall forming part of the cavity. A gas delivery system is provided for feeding gas into and through the permeable wall element to discharge through its inner wall. An annular oil plate is mounted between the overhang and the permeable wall element and this oil plate has grooves in its bottom face thereby provide access for lubricating oil to the mould cavity. An oil supply system is provided for feeding a volumetrically controlled amount of lubricating oil through the grooves to the mould cavity. In this way, oil and gas are supplied to the mould cavity to form an oil and/or gas layer between the metal and the wall of the mould.

A further feature of this invention is a process for operating the above casting apparatus, as described in greater details hereinafter.

The combination of the annular oil plate for delivering the oil and the permeable wall element for delivering the gas to the mould provides a superior system. With the system of this invention, it is possible to deliver the oil to the oil plate at a pressure which is less than the gas pressure delivered to the permeable wall element, so that there is no substantial contamination of the permeable wall element by means of the lubricating oil even though there is fluid communication between the oil plate grooves and the permeable wall section. At times gas may escape from the top surface of the permeable wall element via the grooves in the oil plate but this does not affect the delivery of lubricant or the general performances of the mould. The use of a volumetric lubricating oil delivery device ensures that small and controlled amounts of lubricant can still be delivered by way of the oil plate grooves. This means that there is no excess lubricant consumption which otherwise exist if oil grooves where designed as the principal means for lubricant flow control.

DESCRIPTION OF THE PREFERRED EMBODIMENTS

The oil supply system represents an important part of the present invention and is preferably in the form of a volumetric feed control device for feeding lubricant oil to the oil plate, preferably via an annular groove or channel formed in the mould body and communicating with the outer ends of the oil plate grooves. This volumetric feed control device supplies a fixed volume of lubricating oil in a given time period, substantially independent of the pressure within the oil plate and annular groove. The volumetric feed control device is preferably a volumetric-type pump, and more preferably an injector-type volumetric pump. The pump preferably operates by delivering oil in pulses, e.g. at a frequency of from about 0.5 to 8.0 per minute, more preferably 0.5 to 4.0 pulses per minute.

The grooves in the bottom of the oil plate are preferably uniformly spaced and of equal cross sectional areas. The ratio of the area of one such groove to the cross sectional area of the oil delivery channel feeding oil to the grooves is preferably less than 0.05, more preferably less than 0.01. The maximum oil pressure within the oil plate is preferably less than 5 psi.

The average lubricating oil flow is preferably from about $0.7\times10^{-4}$ to about $1.8\times10^{-4}$ ml/min/mm of mould circumference to each mould. A synthetic oil is preferably used as the lubricating oil and typical of such oils are Mobil Artic 220, Mobil Artic 230 and Magnus CAL 192.

The permeable wall element is typically made from a porous metal or porous graphite material. An annular gas supply ring surrounds the wall element and this may be in form of an annular groove machined or formed into the surface of the permeable wall element itself, or it may be machined into the mould body immediately adjacent the permeable wall element. The gas pressure as measured in the annular gas supply ring is preferably in the range of 5 to 30 psi. The gas flow rate to the annular gas supply ring is preferably in the range of 0.0011 to 0.0040 liters of gas per minute per mm of mould perimeter, more preferably 0.0014 to 0.0040 liters of gas per minute per mm of mould perimeter.

As stated above, the maximum oil pressure as measured in the oil plate does not exceed the gas pressure as measured in the annular gas supply ring. The maximum oil pressure in the oil plate is preferably less that 75% of the gas pressure as measured in the annular gas supply ring.

The ratio of oil flow to each mould relative to the gas flow to each mould is preferably less than $20\times10^{-5}$, more preferably less than $13\times10^{-5}$.

BRIEF DESCRIPTION OF THE DRAWINGS

The invention is explained in more detail with reference to the exemplary embodiments, and are represented in the drawings, wherein.

Figure 1:
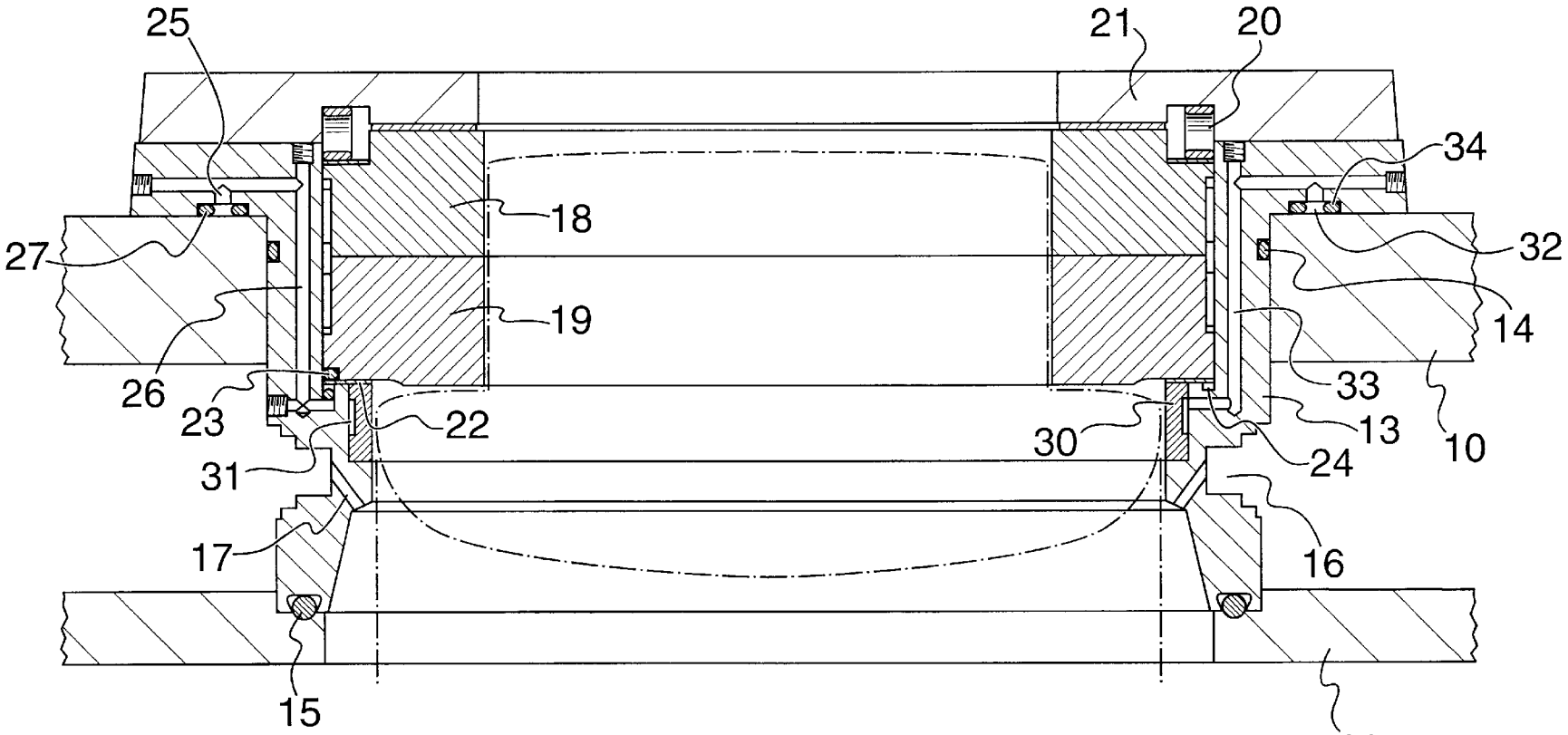
FIG. 1 is a vertical cross section of a mould according to one embodiment of the present invention.

In the embodiment shown in FIG. 1, a casting table is provided having an upper plate 10 and a lower plate 11. Fitted within the table are one or more casting mould bodies 13 sealed to the table by means of O-rings 14 and 15. The mould body has an annular water channel 16 with a series of water delivery holds 17 drilled between the channel and the lower inner surface of the mould body 13 to deliver coolant to an ingot surface (shown in dotted lines) as it is withdrawn from the mould. Other mould body designs may have internal water channels within the mould body rather than on the surface as shown, and water may be delivered to the ingot surface by means of a slot or slots rather than holes. The space between the upper and lower plates of the casting table contains water channels for feeding these casting mould bodies.

A pair of refractory rings 18 and 19 are provided in an annular space in the upper portion of the mould body 13 and these are held in place by a wave spring 20 and a hold down plate 21. A refractory fibre gasket fills any remaining gap.

An annular oil plate 22 is fitted within the mould immediately beneath the lower refractory ring 19 and is sealed with an O-ring 23. In the lower surface of the oil plate 22 are a series of grooves (not shown) having a semi circular cross section with a radius of 0.13 mm. These grooves are spaced at 12.6 mm intervals around the inner perimeter of the oil plate. At the outer perimeter of the oil plate 22 an annular groove 24 is machined into the mould body so that it is in fluid communication with the grooves on the underside of the oil plate 23. The cross sectional dimensions of the annular grooves are 1.65 mm wide and 2.0 mm deep. The annular oil groove is connected to an oil inlet 25 in the mould table by a drilled channel 26 and sealed to the table by O-rings 27.

A porous graphite annular ring 30 is mounted within the mould body 13, this ring 30 having an annular groove 31 machined into the back surface thereof. A gas supply inlet 32 is provided in the mould table and connects to a gas passage 33 which terminates at the groove 31 in the graphite ring 30. Other mould designs may place an annular ring in the mould body, or may use a series of equally spaced holes drilled partly into the graphite annular ring, or a series of equally spaced holes in the mould body connected by internal passages within the mould body. The gas supply inlet 32 mates with a gas feed line within the table by means of an O-ring seal 34. The annular oil plate 22 sits directly on top of the porous graphite ring 30 with the grooves on the underside of the oil plate being in direct fluid communication with the surface of the graphite ring 30.

Figure 2:
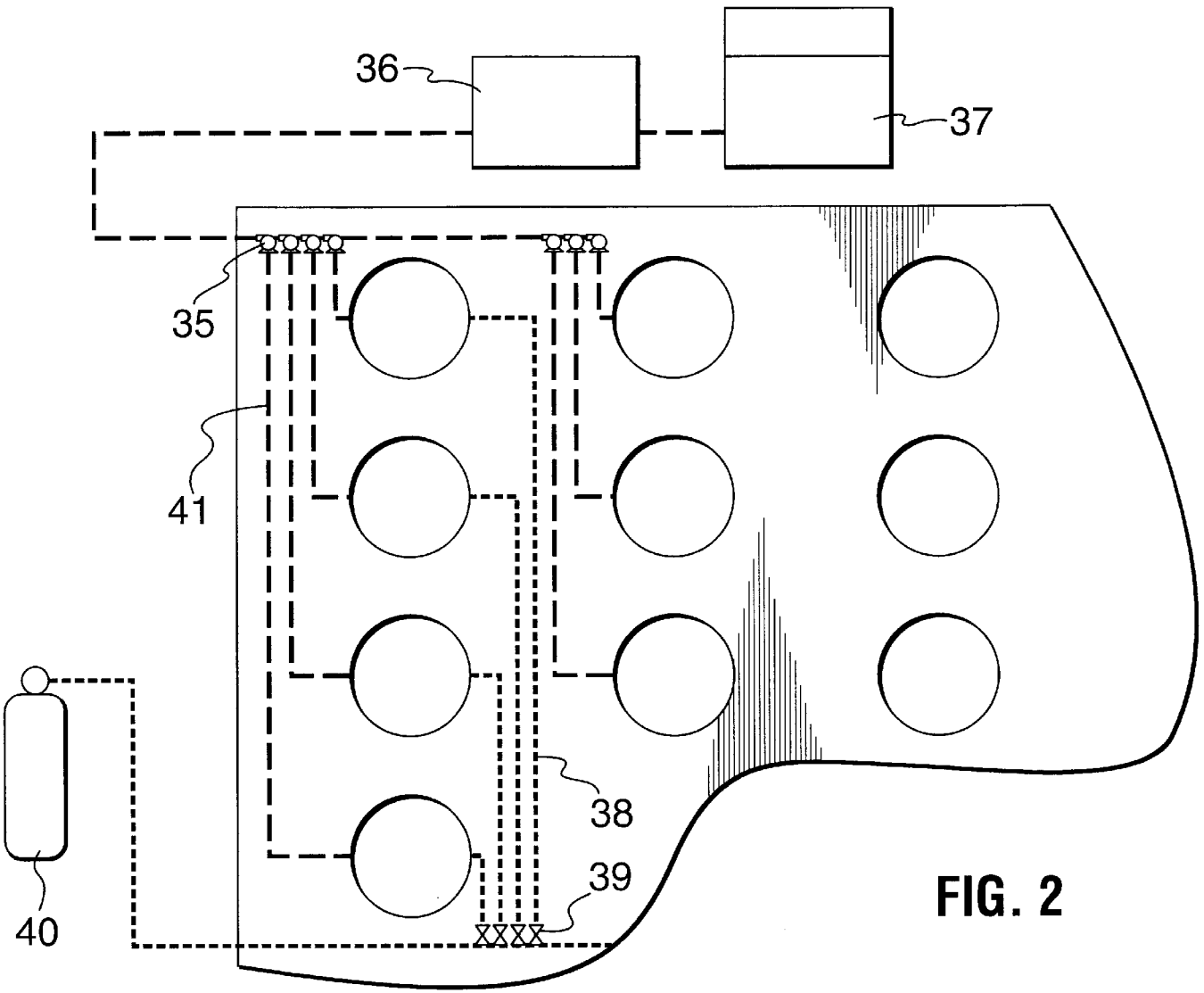
FIG. 2 is a plan view of a mould table containing several moulds of the type shown in FIG. 1.

A portion of a casting table containing moulds of the present invention is shown in FIG. 2. An injector pump 35 is provided for each mould and is capable of delivering predetermined volumetric pulses of oil through lines 41 to the oil plate 22 on a periodic basis. Pumps such as models SL-42 of SL-43 manufactured by Lincoln may be used. The injector pumps 35 may be mounted at the edge of the table as shown or adjacent to each mould. The injector pumps are feed by a single oil pump 36 from an oil reservoir 37. This single oil pump can operate at a substantial pressure since the injector pumps themselves can provide constant volumetric delivery for a high input pressure. The volumetric delivery can be made on a periodic basis using injector pumps as described above or on a continuous basis.

The gas supply inlet 32 in each mould is joined to a gas line 38 in the table which is in turn connected to a metering valve 39. A separated metering valve is used for each mould. These gas lines and metering valves are in turn connected to a source of inert gas 40. The source of inert gas may be any source normally provided, including a compressed gas cylinder or a compressor for example.

The mould is typically used in the following manner. At the start of a direct chill cast, base plates or stool caps (not shown) are in position within the bottom of each mould body. Molten metal is delivered to the top of each mould cavity, for example, by means of a dip tube and float arrangement, or by means of refractory channels on top of the mould table (referred to as a level pour system). Prior to the start of metal flow into the mould cavity, the gas and lubricant system is started. The oil and gas flows are adjusted to their predetermined values as required by the cast. Depending on the type or grade of graphite used in the permeable wall element, the gas pressure in the annular gas supply ring may vary between 5 and 25 psi to obtain the desired gas flows. Because the oil flow enters via the grooves in the bottom of the oil plate and only gas flows via the permeable wall element, there is no initialization effect and both the oil and gas flows reach their desired conditions almost immediately. The metal then flows into the mould cavity and forms an initial frozen ingot butt, at which time the stool cap of the mould is lowered simultaneously so that an ingot can develop. During the cast, the gas pressure typically lies within the range of 5 to 25 psi depending on the porosity of the permeable wall, and the oil pressure typically does not exceed 4 psi. Because of the uniformity of the machined grooves in the oil plate and the size of the annular oil delivery ring, the distribution of the oil through all grooves is uniform. Although the porosity of the permeable wall element is not critical, it is important that the porosity be sufficiently uniform around the mould to achieve a reasonably uniform gas distribution.

It is claimed:

1. An apparatus for direct chill casting of metal comprising:

an open ended mould cavity formed by a casting surface with an upper end and a lower end;

a refractory sleeve located at the upper end of said mould cavity and having an inner diameter less than the inner diameter of the mould whereby the sleeve forms an overhang with the mould cavity, said sleeve being adapted to receive molten metal;

a coolant delivery system below the lower end of the mould for supplying coolant to chill the descending hot metal body;

a permeable wall element disposed in the peripheral wall of the mould cavity below the overhang, said element having an inner wall forming part of the cavity;

a gas supply system for feeding gas into and through the permeable wall element to discharge through said inner wall;

an annular oil plate mounted between the overhang and the permeable wall element, said oil plate having grooves in the bottom face thereof providing access for lubricating oil to the mould cavity;

oil supply system for feeding a volumetrically controlled amount of lubricating oil through the grooves to the mould cavity;

whereby oil and gas are supplied to the mould cavity to form an oil and/or gas layer between the metal and the wall of the mould.

2. An apparatus according to claim 1 which includes an annular channel formed in the mould body and communicating with the outer ends of the oil plate grooves.

3. An apparatus according to claim 2 wherein the oil supply system comprises a volumetric pump adapted to feed a controlled volume of lubricant through said annular channel and grooves independent of pressure.

4. An apparatus according to claim 3 wherein the pump is an injector type volumetric pump.

5. An apparatus according to claim 4 wherein the permeable wall element is formed from a porous metal or porous graphite material.

6. An apparatus according to claim 5 wherein the permeable wall element includes an annular gas supply groove surrounding the wall element.

7. A process for the direct chill casting of a metal in an open ended mould cavity formed by a casting surface with an upper end and a lower end, a refractory sleeve located at the upper end of the cavity and having an inner diameter less than the inner diameter of the mould whereby the sleeve forms an overhang with the mould cavity, coolant supply means below the lower end of the mould, a permeable wall element in the peripheral wall of the mould cavity below the overhang and forming part of the inner wall of the cavity, and an annular oil plate mounted between the overhang and the permeable wall element, the plate having grooves in the bottom face providing access for lubricating oil to the mould cavity;

the process comprising the steps of continuously filling the upper end of the cavity with molten metal and permitting the molten metal to move downwardly through the mould to form an ingot;

simultaneously pumping a controlled flow of lubrication oil through said oil plate grooves into the mould cavity;

simultaneously forcing a gas through said permeable wall element into the mould cavity; and simultaneously chilling the ingot by spraying coolant on the ingot from said coolant supply means, whereby oil and gas are supplied to the mould cavity to form an oil and/or gas layer between the metal and the wall of the mould and the ingot is chilled.

8. A process according to claim 7 wherein the oil is pumped in a controlled volume flow independent of pressure.

9. A process according to claim 8 wherein the oil is pumped in pulses at a frequency of from about 0.5 to 8.0 per minute.

10. A process according to claim 9 wherein the oil is pumped into the oil plate grooves at a pressure of less than 5 psi.

11. A process according to claim 10 wherein the oil is pumped at a rate of from about $0.7\times10^{-4}$ to $1.8\times10^{-4}$ ml/min/mm of mould circumference.

12. A process according to claim 11 wherein the gas is fed to the permeable wall element at a pressure in the range of 5–30 psi.

* * * * *